United States Patent [19]

Triguero

[11] Patent Number: 5,005,543

[45] Date of Patent: Apr. 9, 1991

[54] INTAKE AND EXHAUST SYSTEM WITH A ROTATING PORT SHAFT FOR FOUR-CYCLE INTERNAL COMBUSTION ENGINES

[76] Inventor: Felix O. Triguero, Virgen de la Fuencisla 33, 28027 Madrid, Spain

[21] Appl. No.: 360,435

[22] Filed: Jun. 2, 1989

[30] Foreign Application Priority Data

Jun. 6, 1988 [ES] Spain ..... 8801765

[51] Int. Cl.[5] ..... F01L 7/00

[52] U.S. Cl. ..... 123/190 BD; 123/190 B; 123/190 BB; 123/190 E

[58] Field of Search ..... 123/190 E, 190 B, 190 BA, 123/190 BB, 190 BD

[56] References Cited

U.S. PATENT DOCUMENTS

| | | | |
|---|---|---|---|
| 2,217,853 | 10/1940 | Baer | 123/190 E |
| 3,945,364 | 3/1976 | Cook | 123/190 DB |
| 4,010,727 | 3/1977 | Cross et al. | 123/190 B |
| 4,098,514 | 7/1978 | Guenther | 123/190 E |
| 4,114,639 | 9/1978 | Cross et al. | 123/190 E |
| 4,160,436 | 7/1979 | Flower | 123/190 B |
| 4,198,946 | 4/1980 | Rassey | 123/190 E |
| 4,333,427 | 6/1982 | Burillo et al. | 123/190 E |
| 4,467,751 | 8/1984 | Asaka et al. | 123/190 E |
| 4,473,041 | 9/1984 | Lyons et al. | 123/190 E |
| 4,751,900 | 6/1988 | Ruffolo | 123/190 BD |
| 4,782,801 | 11/1988 | Ficht et al. | 123/190 BD |
| 4,834,038 | 5/1989 | Montagni | 123/190 E |

*Primary Examiner*—Andrew M. Dolinar
*Assistant Examiner*—M. Macy
*Attorney, Agent, or Firm*—Ladas & Parry

[57] ABSTRACT

Improvements to a rotating-port-shaft intake and exhaust system in four-cycle internal combustion engines, the system being based on a hollow shaft mounted on a cylinder head and provided with ports leading independently to the cylinder chambers. The improvements consist in the fact that the cylinder head is made up of two halves which, on their opposing faces, are provided with semi-cylindrical cuts that form a cylindrical duct in which to house the port shaft. The cylinder head in question is provided with orifices for assembling sealing pistons with rectangular openings serving as ports and opposing the orifices/ports of the shaft. The upper faces of these pistons are ground with the same diameter as the shaft in order to achieve a perfect fit between both parts.

14 Claims, 3 Drawing Sheets

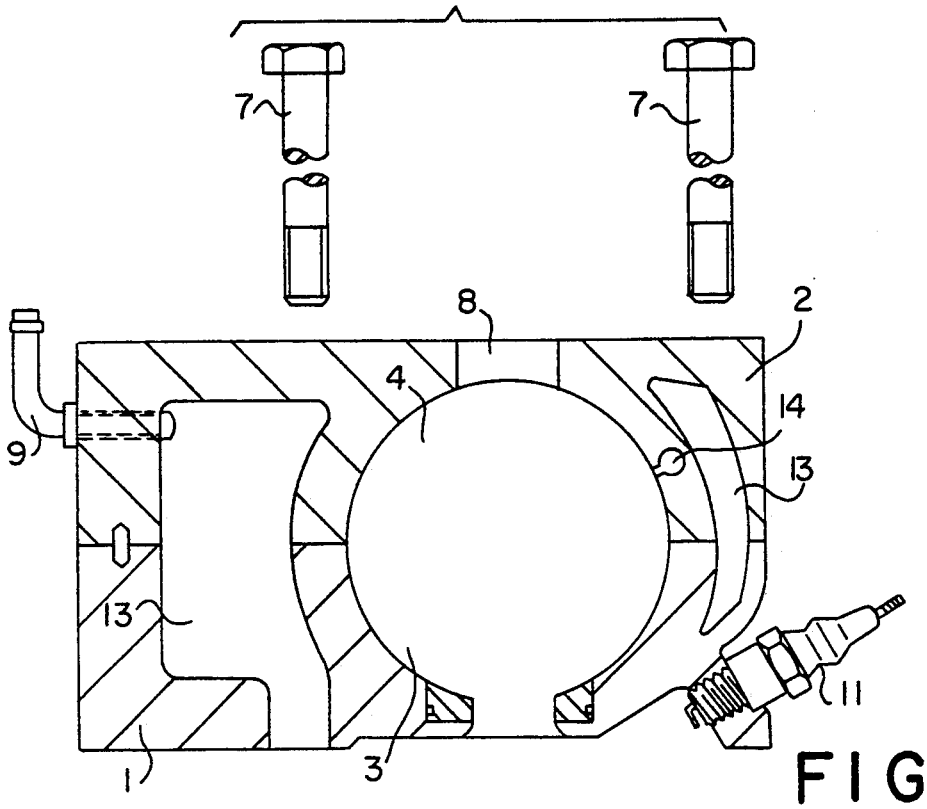
FIG. 2
FIG. 3
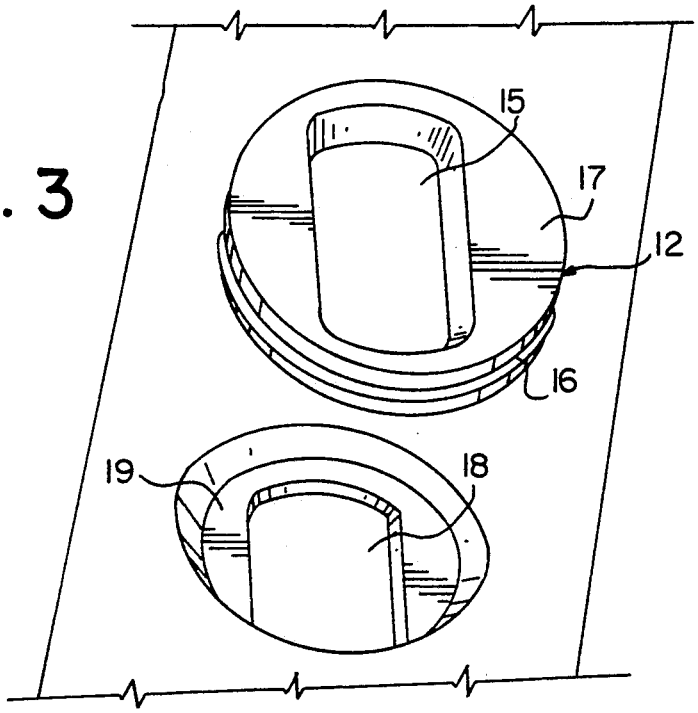

INTAKE AND EXHAUST SYSTEM WITH A ROTATING PORT SHAFT FOR FOUR-CYCLE INTERNAL COMBUSTION ENGINES

The invention refers to improvements made to an intake and exhaust system with a rotating port shaft for four-cycle internal combustion engines, improvements which make it easier and cheaper to construct the engine of which the intake and exhaust system forms a part.

The system claimed in U.S. Pat. No. 4,879,979 by the applicant himself is based on a rotating port shaft mounted on the cylinder-head body. This shaft is complemented by an external liner and, at one of its ends, is provided with a pinion which receives the rotation of the engine crankshaft itself.

The shaft in question is likewise provided with a water based cooling system by which the water enters through one of the ends and comes out through the other in a centrifugal manner, arriving at a ring-shaped chamber connected to the cylinder-head cooling water. There is also a lubrication system based on a ring-shaped chamber planned for the cylinder-head body or liner, with the oil coming under pressure into this chamber from the engine, being sent along the liner by the rotation of the shaft.

The shaft includes a series of segments which fit inside the liner and which serve to make the cylinders more independent.

As for the ports, these make up a rectangular duct going from one end of the shaft to the other. All of them are independent and allow the cooling water to pass through the shaft in question.

When this shaft rotates, the different ports will coincide with the respective cylinders in accordance with the established explosion sequence, in such a way that a complete engine cycle will take place with every half revolution of the shaft. With the ports being used again in the opposite direction, another complete cycle will take place with every half revolution of the shaft. With the ports being used again in the opposite direction, another complete cycle will take place during the next half revolution, and so the rotation ratio with regard to the crankshaft will be ¼.

The advantages and performances offered by an internal combustion engine based on the system described and which is claimed under U.S. Pat. No. 4,879,979 were clearly set out in the descriptive account of the later, and consequently there is no need to reiterate that information at this time.

According to what has been described so afar, the improvements put forward are carried out on the engine assembly or system described in and corresponding to the relevant U.S. Pat. No. 4,879,979. These improvements, first of all, are based on constructing the cylinder head in two parts or halves, thus making it easier to mechanize the cylinder head and resulting in a cheaper manufacturing process. Constructing the cylinder head in two halves means there is no long need to put a liner on the shaft, with the result being a corresponding savings in money and further simplification of the engine.

The adjustment for sealing the cylinders is achieved by means of small pistons, each one for a segment, which serve the purpose of the valves in traditional systems but with the feature that these pistons are perforated in order to form the port leading to the combustion chamber.

The engine is also sealed quite simply by providing the bottom part of the cylinder head with rectangular segments which are constantly being pushed by expansion springs, while these segments are complemented with a toric gasket in order to ensure the sealing.

Furthermore, the fact of the cylinder head is made up of two halves means that two or more intermediate support points can easily be put in for the port shaft. This is particularly useful in the case of six-cylinder engines or engines with a very long shaft.

In order that the characteristics of the invention may be better understood, there follows a detailed description based on a set of drawings attached to and forming an integral part of this descriptive account, and in which the following points have been represented merely as a guideline and in a non-restrictive way:

FIG. 2 is a cross-section view of the cylinder head.

FIG. 3 is an overall top view of one of the small sealing pistons in the position of being placed in the corresponding port orifice.

Figure 1:
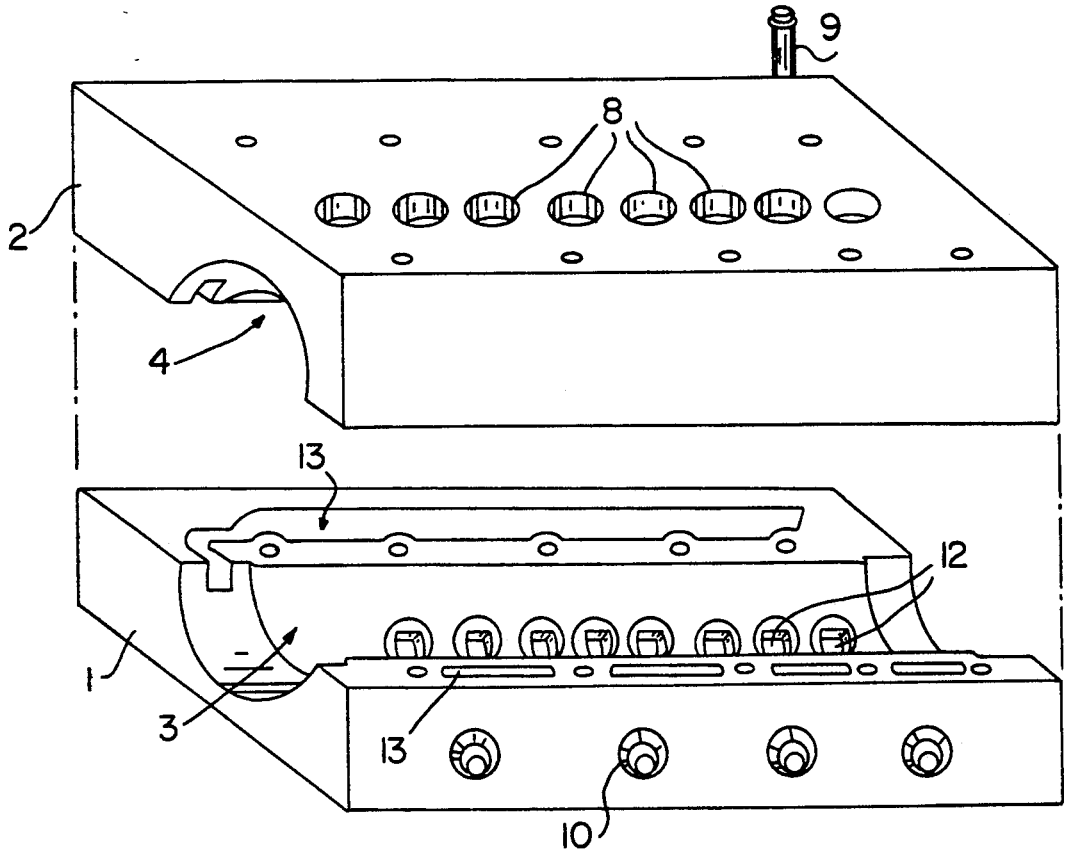
FIG. 1 is an exploded view of the two halves that make up the cylinder head.

As can be seen from the drawings in question, the improvements put forward consist firstly in the fact that the cylinder head forming part of the purpose of the invention is made up of two halves, (1) and (2), in the opposing, or coupling, faces of which there is a longitudinal cut, (3) and (4), respectively. The latter has a semicircular profile in order to form a cylindrical passage along which will run the corresponding shaft (5), this being hollow and provided with the respective ports (6). The two halves, (1) and (2), are fitted together by means of studs (7) which, in their turn, fix the cylinder head on the engine block.

The corresponding manifolds are coupled on the upper half (2) through the holes (8) provided for this purpose. The duct (9) for the cooling liquid circulation sleeve is likewise coupled.

The lower half is provided with threaded holes (10) so that the spark plugs (11) can be screwed in, as well as with other housings for the respective static pistons (12) which constitute the means of sealing the cylinders.

Also included in this cylinder-head make-up are the cooling chambers (13) and the combustion chamber with its spark plug (11), apart from the components and parts mentioned and a lubrication duct (14).

As a result of this configuration and design, the cylinder head is easier to merchandize, and no external liner is required for the rotating port shaft (5) because a perfect fit for sealing the cylinders is achieved by means of the shaft and the small pistons (12) which serve the purpose of the valves used in traditional systems.

The sealing pistons (12), one of which is shown in FIG. 3, have a wide rectangular orifice (15) and are provided with a ring-shaped segment (16) which fulfills two basic functions. One of these is to ensure better sealing while the other is that, when the fact (17) which fits against the surface of the shaft is getting worn, it is always kept tightly in place, thereby preventing play in the housing fit and wear in the piston or the segment since these are totally static. The upper face (17) of these pistons (12) is ground with the same diameter as the rotating port shaft (5) thus giving a perfect fit between the two parts, and this fit will become more effective during the engine compression and expansion stages since the very pressure of the cylinder gases acting on the inside face presses the piston (12) against the ground surface of the rotating port shaft.

The perforations (15) of the aforementioned pistons (12) are in fact the true ports that lead to the combustion chamber through the corresponding orifice (18), as is shown in FIG. 3, an orifice (18) which is opened in the housing (19).

Figure 4:
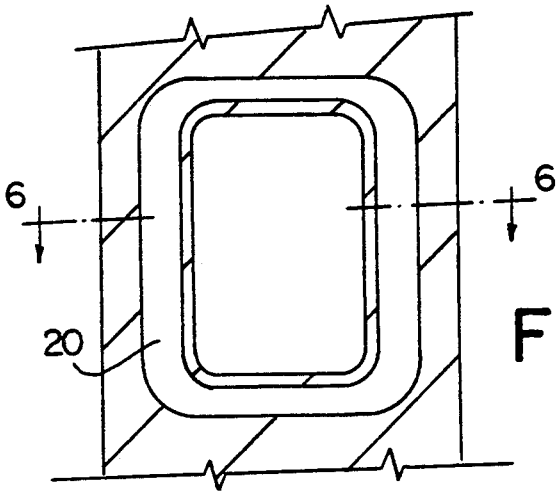
FIG. 4 is a top view of one of the segments or adjustment pieces which can be used as a variant of the sealing pistons in FIG. 3 in order to attain the engine sealing.
Figure 6:
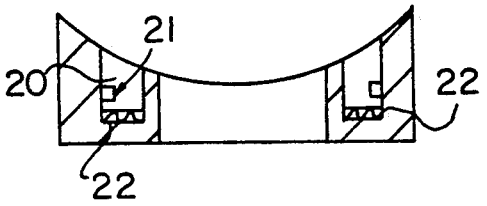
FIG. 6 is a sectional view according to the 6—6 cutting line shown in FIG. 4.

The engine can also be sealed by providing the lower part of the cylinder head with rectangular segments (20), as can be seen in FIGS. 4 and 6, with these segments being housed in their casings, and also with the surface that is in contact with the rotating port shaft being ground, bringing about a perfect fit due to the pressure exerted on these segments by the expanding springs (22). These segments (20) include a high-temperature toric rubber (21) fitted to their outside faces as a retainer in order to have a tight seal at the side. Other types of sealing segments or pistons can also be designed.

Figure 5:
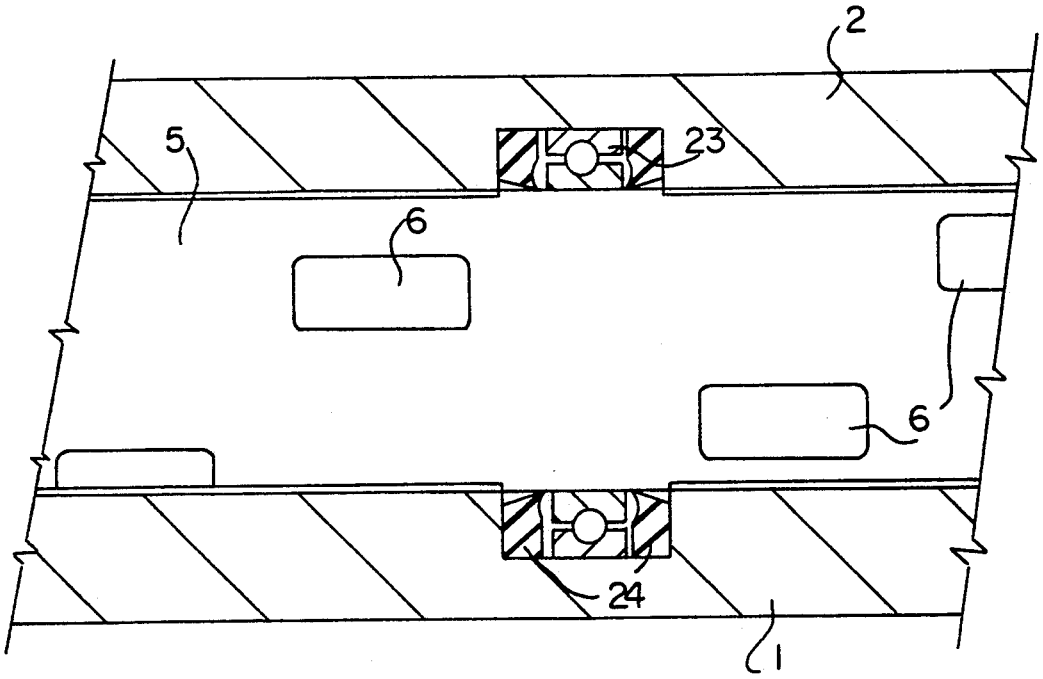
FIG. 5 is a longitudinal-section view of part of the hollow shaft running between the two halves that make up the cylinder head.

Due to the fact that the cylinder head is made up of two halves, one can see in FIG. 5 how the shaft (5) can be supported on one or more intermediate points by means of the corresponding bearings (23) and retainers (24), especially in the case of six-cylinder engines or in those which have large-diameter cylinders. The shaft in the latter type is too long and vibrations may cause it to snap, but this problem is avoided by having recourse to the above solution.

What is claimed is:

1. An intake and exhaust system with a rotating port shaft having both intake and exhaust means for internal combustion engines, said system comprising: a cylinder head having two halves, a first half and a second half, both said halves being provided with an axial, semi-cylindrical cut in their opposing faces which, when fitted together, form a longitudinal, cylindrical duct housing the rotating shaft, said cylinder head having a cooling duct for a cooling liquid circulation sleeve, said first half having first orifices for coupling with intake and exhaust manifolds, said second half having threaded second orifices for receiving spark plugs, said second half having third orifices which house static pistons for sealing each cylinder.

2. The intake and exhaust system as claimed in claim 1, wherein said pistons comprise ring-shaped segments having a rectangular opening with said piston having an upper face of the same diameter as the rotating port shaft.

3. The intake and exhaust system as claimed in claim 1 wherein said pistons are rectangular in shape, said third orifices are also rectangular in shape, said pistons are housed in said third orifices, said pistons having temperature toric gaskets to provide better sealing and further comprising expansion springs disposed between said third orifices and said pistons, set in position by means of connected expander springs.

4. The intake and exhaust system as claimed in claim 1 wherein said two halves that make up the cylinder head are joined together by means of studs which, at the same time, serve to fix the cylinder head to the engine block.

5. The intake and exhaust system as claimed in claim 1 wherein the rotating port shaft is supported on one or more intermediate points by means of corresponding bearings and retainers located on said duct housing of said cylinder head.

6. The intake and exhaust system as claimed in claim 2, wherein said two halves that make up the cylinder head are joined together by means of studs which, at the same time, serve to fix the cylinder head to the engine block.

7. The intake and exhaust system as claimed in claim 3, wherein said two halves that make up the cylinder head are joined together by means of studs which, at the same time, serve to fix the cylinder head to the engine block.

8. The intake and exhaust system as claimed in claim 2, wherein the rotating port shaft is supported on one or more intermediate points by means of corresponding bearings and retainer located on said duct housing of said cylinder head.

9. The intake and exhaust system as claimed in claim 3, wherein the rotating port shaft is supported on one or more intermediate points by means of corresponding bearings and retainer located on said duct housing of said cylinder head.

10. The intake and exhaust system as claimed in claim 4, wherein the rotating port shaft is supported on one or more intermediate points by means of corresponding bearings and retainer located on said duct housing of said cylinder head.

11. An intake and exhaust system, the system having a single rotary shaft containing both intake and exhaust means, said system comprising:

a cylinder head having two halves, a first portion and a second portion, both first and second portions having thereon semi-cylindrical cuts so that when said first and second portions are fitted together, a longitudinal cylindrical duct is formed for housing the single rotary shaft, said second portion having on a surface adjacent to the rotary shaft an orifice; and a sealing piston formed to fit in said orifice, said sealing piston having an opening formed thereon, said sealing piston having a periphery and said sealing piston further comprising a ring-shaped segment around said periphery to provide a better fit and seal.

12. An intake and exhaust system, the system having a single rotary shaft containing both intake and exhaust means, said system comprising:

a cylinder head having two halves, a first portion and a second portion, both first and second portions having thereon semi-cylindrical cuts so that when said first and second portions are fitted together, a longitudinal cylindrical duct is formed for housing the single rotary shaft, said second portion having on a surface adjacent to the rotary shaft an orifice; a sealing piston formed to fit in said orifice, said sealing piston having an opening formed thereon; and high temperature toric gaskets fitted around said sealing pistons to provide better sealing.

13. The system as claimed in claim 12 wherein said orifice and its corresponding sealing piston is of rectangular shape.

14. An intake and exhaust system, the system having a single rotary shaft containing both intake and exhaust means, said system comprising:

a cylinder head having two halves, a first portion and a second portion, both first and second portions having thereon semi-cylindrical cuts so that when said first and second portions are fitted together, a longitudinal cylindrical duct is formed for housing the single rotary shaft, said second portion having on a surface adjacent to the rotary shaft an orifice, said cylinder head further having threaded annular openings for attachment of spark plugs; and a sealing piston formed to fit in said orifice, said sealing piston having an opening formed thereon.

* * * * *